US007313528B1

(12) United States Patent
Miller

(10) Patent No.: US 7,313,528 B1
(45) Date of Patent: Dec. 25, 2007

(54) DISTRIBUTED NETWORK BASED MESSAGE PROCESSING SYSTEM FOR TEXT-TO-SPEECH STREAMING DATA

(75) Inventor: Eric Miller, Olathe, KS (US)

(73) Assignee: Sprint Communications Company L.P., Overland Park, KS (US)

( * ) Notice: Subject to any disclaimer, the term of this patent is extended or adjusted under 35 U.S.C. 154(b) by 897 days.

(21) Appl. No.: 10/631,190

(22) Filed: Jul. 31, 2003

(51) Int. Cl.
*G10L 21/00* (2006.01)

(52) U.S. Cl. ..... 704/270.1; 704/260; 704/270; 704/275

(58) Field of Classification Search ..... 704/260, 704/3, 201, 270, 275, 258, 270.1; 715/760; 719/328; 379/88.01
See application file for complete search history.

(56) References Cited

U.S. PATENT DOCUMENTS 5,945,989 A * 8/1999 Freishtat et al. ..... 715/760
6,173,250 B1 * 1/2001 Jong ..... 704/3
6,175,822 B1 * 1/2001 Jones ..... 704/270
6,230,130 B1 * 5/2001 Castello da Costa et al. ..... 704/258
6,466,654 B1 * 10/2002 Cooper et al. ..... 379/88.01
6,757,362 B1 * 6/2004 Cooper et al. ..... 379/88.01
7,137,126 B1 * 11/2006 Coffman et al. ..... 719/328
2002/0059073 A1 * 5/2002 Zondervan et al. ..... 704/270.1
2004/0049389 A1 * 3/2004 Marko et al. ..... 704/260

* cited by examiner

*Primary Examiner*—Vijay Chawan

(57) ABSTRACT

Text-to-speech streaming data is output to an end user using a distributed network based message processing system. The distributed network system includes a user access server that controls access of registered users to the data retrieval system. An internetwork data retrieval system server retrieves raw data from an internetwork. A text-to-speech server converts the raw data to an audible speech data. A memory storage output device stores a streaming media file containing the audible speech data and a streaming media server transmits the audible speech data to the registered users via the internetwork.

33 Claims, 6 Drawing Sheets

DISTRIBUTED NETWORK BASED MESSAGE PROCESSING SYSTEM FOR TEXT-TO-SPEECH STREAMING DATA

CROSS REFERENCE TO RELATED APPLICATIONS

Not Applicable.

STATEMENT REGARDING FEDERALLY SPONSORED RESEARCH

Not Applicable.

BACKGROUND OF THE INVENTION

1. Field of the Invention

The present invention relates in general to streaming data, and more specifically, to a distributed network based system for retrieving data from an internetwork and converting the data to text-to-speech for a registered user.

2. Description of the Related Art

In today's advanced electronic economy, information is retrieved from a variety of sources using various devices. News and stock reports, email messages, and sports information are only some of the information retrieved from devices such as pagers, advanced phone systems, and the internet. Given the busy schedule of people's lifestyle, it is understood that a majority of the people are trying to accomplish an increasing number of tasks in a given time period or schedule. Reading reports and messages to remain updated or informed on the economy becomes an increasingly time consuming event. Reading newsworthy updates and events in electronic format usually requires focus on the subject matter at hand. Furthermore, extended work hours especially for that portion of the economy that performs much of their work on the computer do not find it pleasing to read such updates and events on the computer at the end of a workday.

Text-to-speech conversion can be performed by software tools that have become available. Text-to-speech software converts words in electronic form to audible form. However, while many products convert text-to-speech, such products are designed to be installed on a single user's computer. These software products require a large amount of memory allocation and periodically require updating due to advances made in the field of text-to-speech applications which can become costly, including the initial installation, to the end user over time if the end user desires to maintain the latest technology.

SUMMARY OF THE INVENTION

In one aspect of the invention, a method is performed for outputting text-to-speech streaming data using a distributed network based message processing system to an end user. The distributed network system includes a user access server for controlling access of registered users to the data retrieval system. An internetwork data retrieval system server retrieves raw data from an internetwork. A text-to-speech server converts the raw data to an audible speech data. A memory storage output device stores a streaming media file containing the audible speech data and a streaming media server transmits the audible speech data to the registered users via the internetwork. During operation a registered user is authenticated. The raw data is retrieved from the internetwork. The raw data is parsed for text passages. The text passages are converted to the audible speech data. The audible speech data is converted to a streaming media file. The streaming media file is stored in a memory storage output device and the streaming media file is output to the registered user.

DETAILED DESCRIPTION OF PREFERRED EMBODIMENTS

Figure 1:
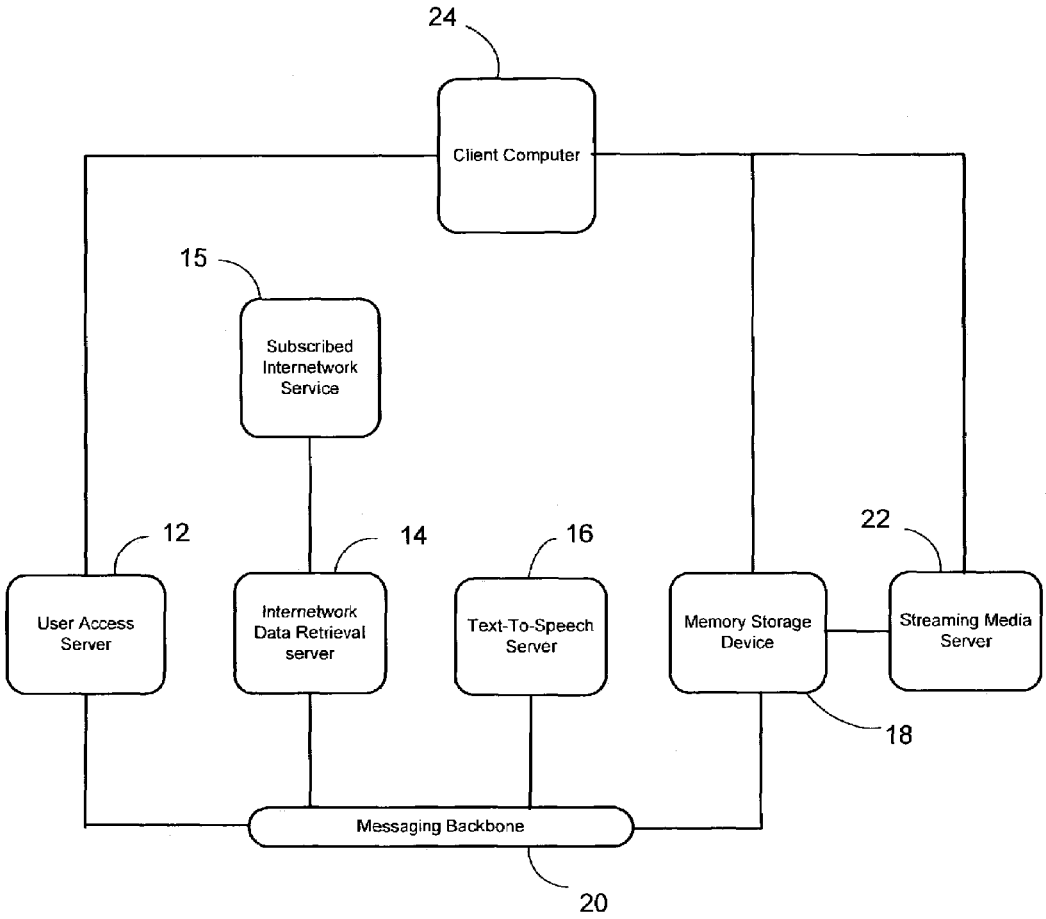
FIG. 1 is a block diagram of a streaming text-to-speech data retrieval system according to a preferred embodiment.

Referring now to the Drawings and particularly to FIG. 1, there is shown a block diagram of a streaming text-to-speech data retrieval system. The data retrieval system includes a distributed network for retrieving internetwork data and converting text portions of the data to spoken audio and streaming the resulting multimedia content to an end-user. The data retrieval system is comprised of at least four mini-servers and a streaming media server. The mini servers include a user access server 12, an internetwork data retrieval server 14, a text-to-speech server 16 (TTS server), and a memory storage component 18.

The user access server 12 registers a new user, authenticates an existing user, and grants a registered user access to the data retrieval system. The user access server 12 further maintains and updates user preferences that are stored in a user preference database.

The internetwork data retrieval server 14 retrieves new data in the form of raw data from a subscribed internetwork service 15 based on the user preferences stored in the user storage database. The subscribed internetwork service 15 is maintained by a service provider that comprises multimedia information in an electronic format. Examples of such providers are internet service providers, phone service providers, pager service providers, and email service providers. The internetwork data retrieval server continuously checks for new data associated with the subscribed internetwork service 15 for a registered user and stores the new data in a temporary file until the TTS server is ready to convert the temporary file.

The text-to-speech server 16 parses the retrieved new data for text portions and converts the text portions to audible speech data which is saved to a streaming media file.

The four mini servers are connected by a XML messaging backbone 20 (messaging system) that handles messaging and notifications between the servers. The servers may be co-located either within a central server, a common hardware device, or may be separately located separately from one another linked by a communication network line such as a LAN line. The memory storage device 18 may preferably be co-located with the streaming media server 22. The architecture of the distributed network system is capable of managing numerous data retrieval services and numerous users. Since the distributed network is network based, an end user needs only a computer 24 with an installed web browser, an email or instant message client, and a multimedia player to manage the audio file, listen to the data, and receive notification that new audio files are present.

Figure 2:
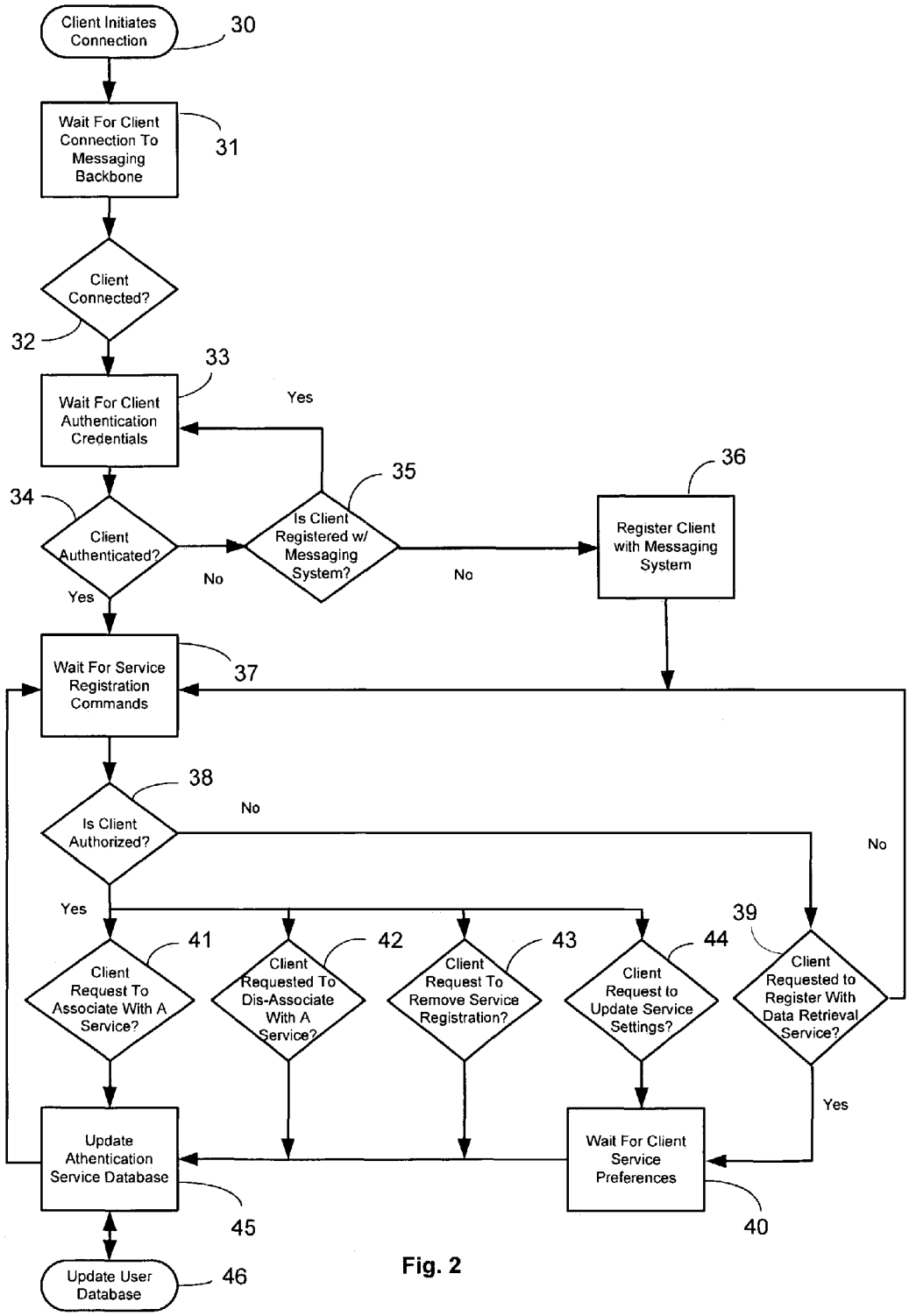
FIG. 2 is a flowchart diagram of a user registration process according to the preferred embodiment.

FIG. 2 illustrates a flow diagram for a new user registration and existing user access to the data retrieval system. The user registration server 12 manages the registration of a new user to the data retrieval system and authorizes an existing user to access their preferences in the data retrieval system. Furthermore, the user registration server 12 tracks the data retrieval services that a user has subscribed to and also maintains and updates a user service database containing the user preferences. The user service database is a customized profile that lists the internetwork services to which the user is subscribed. Information within the user database may also include operating system configuration and capabilities of the user's (client's) computer.

In step 30, a user initiates a connection with the data retrieval system. In step 31, the data retrieval system waits for a user connection to the messaging system. A determination is made whether the user is connected to messaging system in step 32. If the determination is made that the user is not connected to the messaging system, a return is made to step 31 to wait for the user connection to the messaging system. If the determination is made in step 32 that the user is connected to the messaging system, the user access server waits for user authentication credentials (e.g. user identification and password) in step 33. The authentication is executed by the messaging system. The authentication credentials assures that a user is a valid user within the data retrieval system. In step 34, a determination is made whether the user is authenticated. If the user is not authenticated, then a determination is made in step 35 whether the user is already registered with the data retrieval system. If the user is registered with the data retrieval system, then return is made to step 33 to wait for the user authentication credentials. Otherwise, if the user is determined not registered with the data retrieval system in step 35, then an attempt is made to register the user with the data retrieval system in step 36. In step 37, the messaging system waits for data service registration commands. In step 38, a determination is made whether the user has authorization within the data retrieval system. Authorization ensures that a valid user has the necessary permissions to use the data retrieval service. The user may be authenticated but not authorized (e.g. the user is delinquent in paying a bill for the data retrieval service). If the user is not authorized, then the messaging system first determines whether the request for registration was made by the user in step 39. If the determination is made that the user did not request registration, then a return is made step 37 to wait for data service registration commands and authorization. If a determination is made that the user did request to register with the data retrieval service, a determination may further be made in step 39 regarding the payment process for access and use of the service. The user may be given payment options to choose from (e.g. subscription, one time payment, a prepaid account, credit card, etc.). The user access server will wait for a valid payment option. Once a valid payment option is validated, the user access server then waits for the user service preferences in step 40. Thus a new user may be able to setup or update their user preferences prior to becoming registered.

In step 41, a determination is made whether the user requested to be associated with a new service provided by a system provider (e.g. news service, sports service, stock service, email service, etc.) In step 42, a determination is made whether the user requested to be disassociated with an existing service. This would incur removing a specified service from the user preference database. In step 43, a determination is made whether the user requested to be removed from a service registration. This would indicate that the user no longer desires to have the data retrieval service available to the user, or that the user had a prepaid subscription and the subscription has expired. In step 45, the authentication service database is updated based on the user's request in step 41, 42, and 43. In step 44, a determination is made whether the user requested to update the service settings. In step 40 the data retrieval system waits for the user service preferences and then updates the authentication service database based on any updates to the service settings as in step 45. Service settings may contain information that is pertinent to the operation, viewing, and transfer of information to the user (e.g. encoders, internet viewers, file transfer protocols). The user database is updated in step 46 and a return is made to step 37 to wait for further service registration commands.

Figure 3:
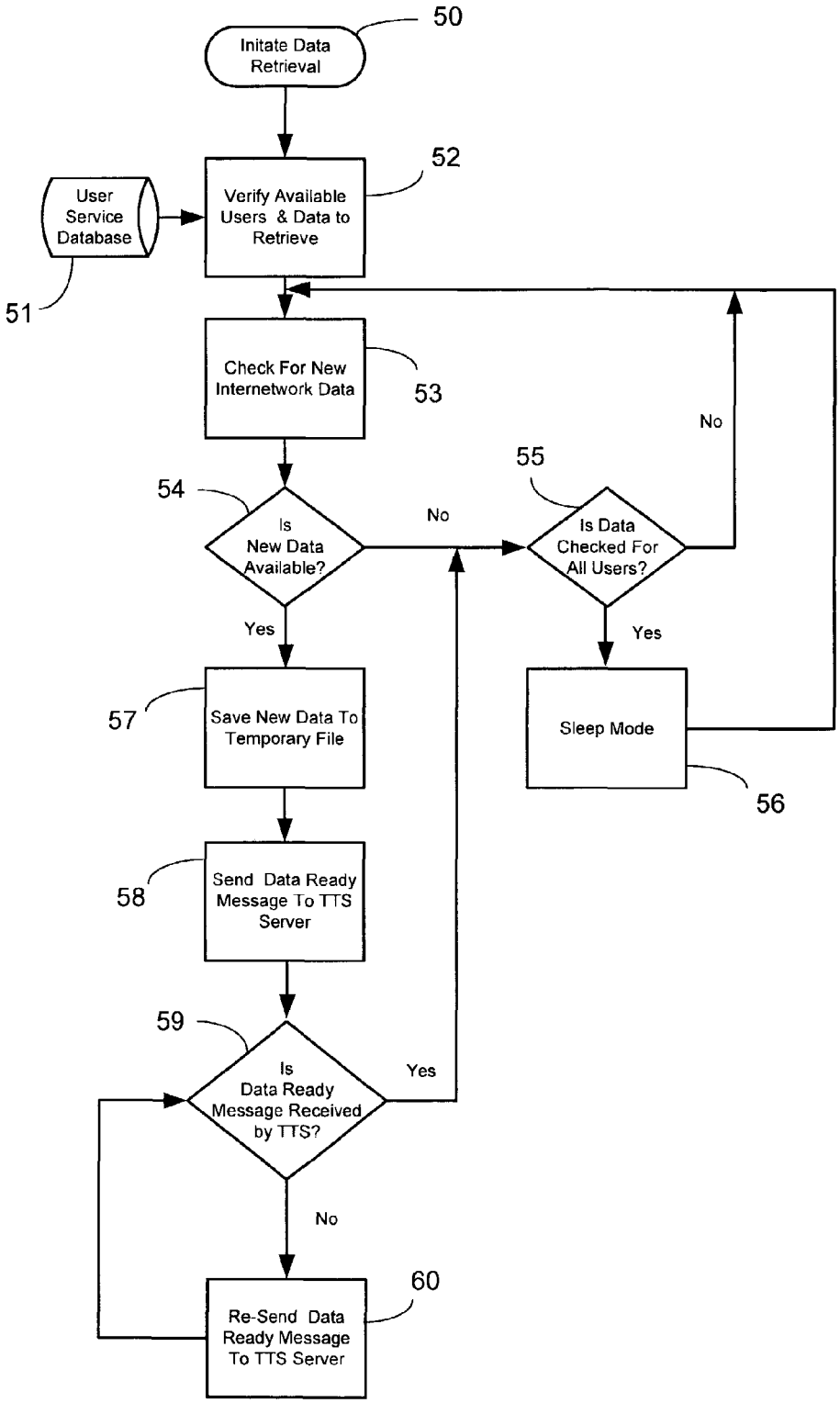
FIG. 3 is a flowchart of a internetwork data retrieval server according to the first preferred indictment.

FIG. 3 illustrates a flowchart for a method by which the data retrieval server periodically retrieves new data from an internetwork based on user preferences identified and stored in the user service database. In step 50, a data retrieval routine is initiated. In step 51, the available users are verified on the data retrieval system. Also, the subscription services associated with the user and user preferences are retrieved from the user service database in step 52 for determining where and what new data is to be retrieved for each respective user. The retrieval system is comprised of a plurality of data retrieval modules. Each data retrieval module retrieves a specific type of data that it was specifically designed to retrieve. For example, if an HTML page is part of a subscribed service and the web page includes various different data types, each data retrieval module associated with a specific data type will scan the web page for each respective data type and retrieve the associated data. In step 53, the data retrieval system checks for new data from each subscribed service identified in the user service database. In step 54, a determination is made whether new data is available. If new data is not available, then a determination is made whether the new data has been checked for all users on the data retrieval system in step 55. If new data has not been checked for all users, then a return is made to step 53. If all new data has been checked for all users in step 55 and it is determined that no new data exists, then the messaging system enters into a sleep mode in step 56. After a predetermined period of time, the messaging system will return to step 53 to check for new data.

Alternatively, the user may manually identify a specific text portion, a specific data block, or a specific file while accessing a subscribed service that the user desires to be retrieved as raw data and converted to a streaming media file. An example would be the user logged on to a subscribed web based service and identifying (such as highlighting) the new data to be retrieved. An option would be available on the data retrieval system to include the highlighted data as part of the new data to be retrieved for converting to the streaming media file.

If a determination was made in step 54 that the new data is available, the new data is stored to a temporary data file in its raw, original format (e.g. HTML for web content, MIME/RFC 822 for email content) in step 57. In step 58, the data retrieval server transmits a data ready message to the TTS server via the messaging system indicating the new data is available and ready to be retrieved. In addition, the data ready message will instruct the TTS server how the TTS server should retrieve the new data. In step 59, a determination is made whether the data ready message is received by the TTS server. If the data ready message was not received by the TTS server, the data retrieval system will resend the data ready message to the TTS server in step 60. A return is made to step 59 to determine if the data ready message was received. The data retrieval system will continuously loop between step 59 and step 60 until the determination is made that the new data message was received by the TTS server. After a determination is made that the data ready message is received by the TTS server, a return is made to step 54 to determine if all new data has been checked for all users.

Figure 4:
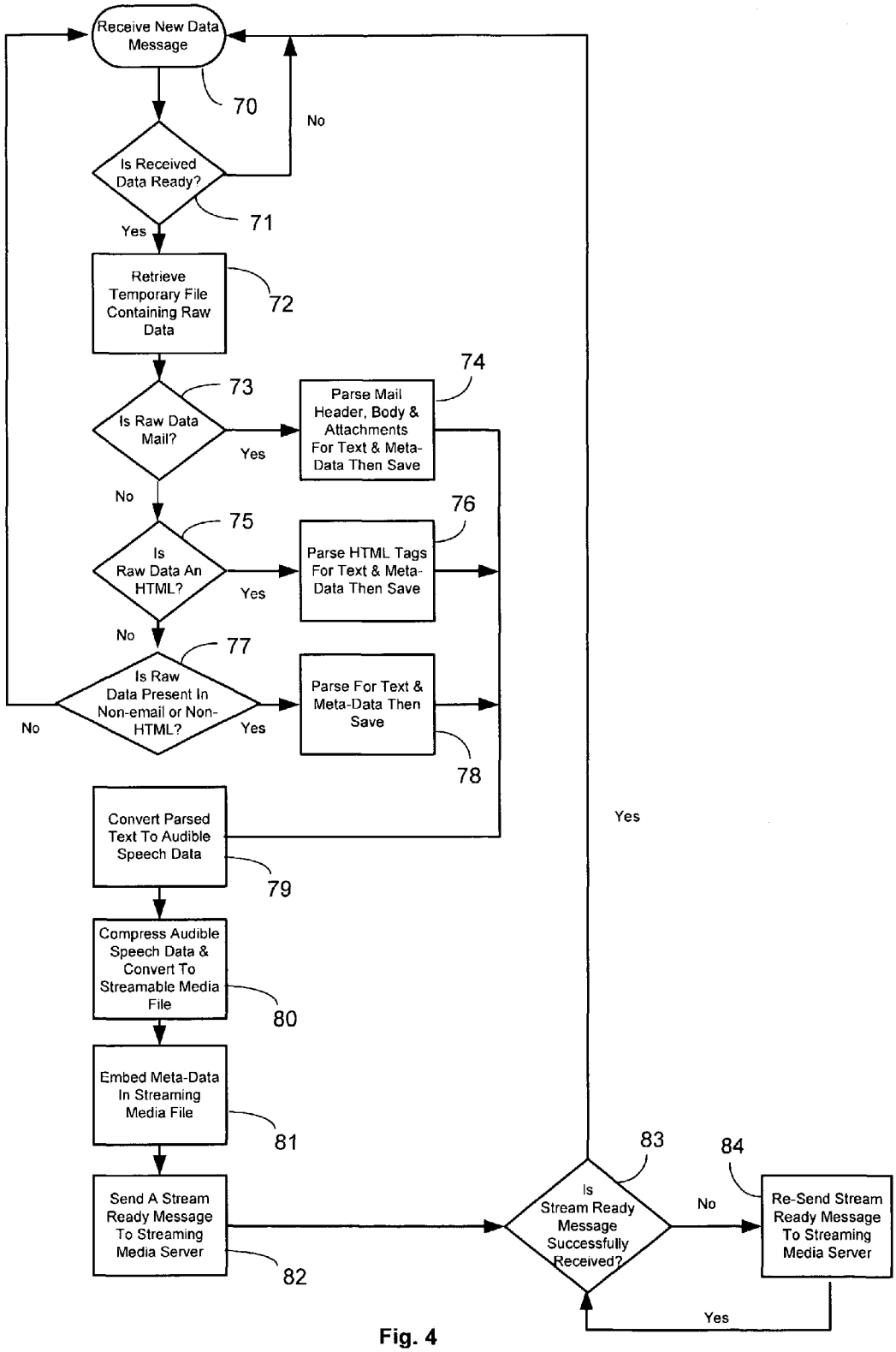
FIG. 4 is a flowchart of a text-to-speech process according to the first preferred embodiment.

FIG. 4 illustrates a block diagram for converting text to a streaming media file according to the preferred embodiment. In step 70, the TTS server receives the data ready message from the internetwork data retrieval server indicating that the new data stored in a temporary file is ready to be transferred. In step 71, a verification is made whether the new data is ready to be received. If the new data is not ready to be received, a return is made to step 70 to await the data ready message. If the new data is ready to be received, then the temporary file containing new data is retrieved in step 72. Since the streaming text-to-speech data retrieval system architecture is distributed, data retrieval and text-to-speech components may be on different servers. As a result, the data retrieval system may use various methods to transfer the files between the internetwork data retrieval server and the TTS server. Examples of transfer methods include distributed file system calls (nfs, cifs), http, ftp, sftp, xmpp, etc. An advantage of using a distributed architecture is the independent queuing of messages. While processing the transfer of data between the servers, if one of the components becomes disabled, the other components will continue to operate and will queue messages destined for a failed component until the failed component becomes active or a backup becomes available. The distributed system can maintain processing with other active components independently of the failed component. When the failed component becomes active, the recently failed component will receive the queued messages and begin processing the queued messages until there are no more queued messages to process.

Once the temporary data file is received, the temporary data file will be parsed. Parsing, herein, is defined as the extraction of a particular type of text data or non-text data from the temporary data file. A plurality of TTS components may be customized to support a particular data parser (e.g. mail, HTML, XML, etc.) so as to parse for a particular search criteria such as text portions, identifiers, phrase, tags, or meta-data. In step 73, a determination is made if the new data is email. If the new data is email, then respective data parser modules parse the email for a header (meta-data), a main body, text attachments, and non-text attachments (meta-data). After parsing is completed, the parsed email data is ready to be converted from its original text format to audible speech data. If the determination is made in step 73 that the new data is not email, then a determination is made in step 75 whether the new data is in HTML. If the new data is HTML, then the HTML is parsed for text and meta-data in step 76. After parsing is complete, the parsed HTML data is ready to be converted from its original format to the streaming media file. If the determination is made in step 73 that the new data is not HTML, then a determination is made in step 77 whether the new data contains any text or meta-data. The temporary file is then parsed for non-email or non-HTML text and meta-data. If the temporary file contains non-email or non-HTML text or meta-data, the temporary file is parsed for text and meta-data in step 78. After the text or meta-data has been parsed, the parsed text data is ready to be converted to a streaming media file. If a determination is made in step 77 that no text or meta-data is present in the temporary file, then a return to step 70 is made to await a new data ready message.

In step 79, the parsed text is then converted to audible speech data. The audible speech data is then converted to a streaming media file in step 80. The audible speech data is compressed (using a media encoder) into a format that can be easily streamed to the end user. The TTS server may contain one or more encoders (e.g. mp3, wmf, mpeg, mov, etc.) for encoding the audible speech data. The user preference database may provide information concerning the particular encoder that will be supported for later retrieval of the streaming media file by the end users computer. In step 81, meta-data that has been retrieved from the new data is encoded using the appropriate encoder and is embedded into the streaming media file. In step 82, the TTS server transmits a streaming media file ready message to the streaming media server. The streaming media file ready message notifies the memory storage component that a new streaming media file is ready to be received and identifies the method by which the memory storage component may access it. In step 83, a determination is made whether the streaming media server successfully received the streaming media file ready message. If the streaming media file ready message was not received by the streaming media server, then the TTS server will resend the streaming media file ready message to the streaming media file server in step 84. The data retrieval system will keep looping between step 83 and 84 until the streaming media file ready message is received by the streaming media server. If the determination was made in step 83 that the streaming media file ready message is received by the streaming media server, then a return is made to step 70 to await a new data ready message.

Figure 5:
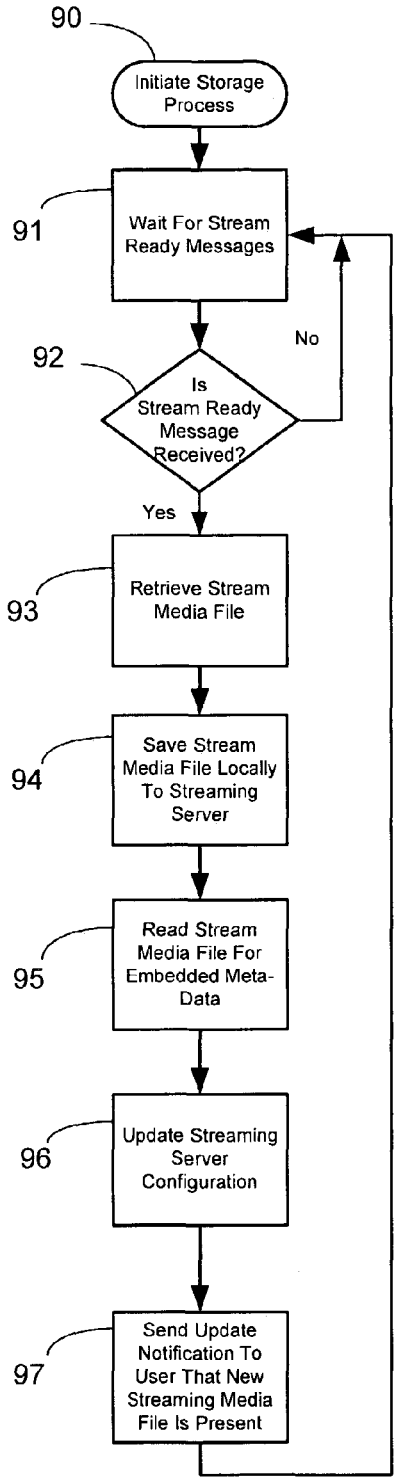
FIG. 5 is a flowchart of a memory storage component and streaming media server according to the preferred embodiment.

FIG. 5 illustrates a flowchart for a method of storing the streaming media file in a memory storage device. In step 90, the memory storage process is initiated. The memory storage component 91 will wait for the streaming media file ready message indicating that the streaming media file is ready to be received. In step 92, a determination is made whether the streaming media file ready message has been received. If the streaming media file ready message is not received, then a return is made to step 91 to await for the streaming media file ready message. If a determination is made in step 92 that the streaming media file ready message is received, then the streaming media file is received using the appropriate method provided in the streaming media file ready message to access and receive it in step 93. The streaming media file is then saved locally to the streaming media server in step 94. The memory storage component may be on an individual mini-server or may be co-located with the streaming media server. There may be one or more storage modules on the memory storage components for interconnecting the data retrieval system to different types of streaming media servers. In step 95, the memory storage component reads the streaming media file to determine if any embedded meta-data is present in the streaming media file. The configuration of the streaming media server is then updated based on the contents of the streaming media file in step 96. A notification is sent to the end user indicating that the new streaming media file is present for retrieval by the end user in step 97. The memory storage component may use one or more methods for sending the notification to the end user such as email, instant messaging, short message service (SMS), and PSTN/voice mail notifications. A return is then made to step 91 to await a next new streaming media file message sent by the TTS server.

Figure 6:
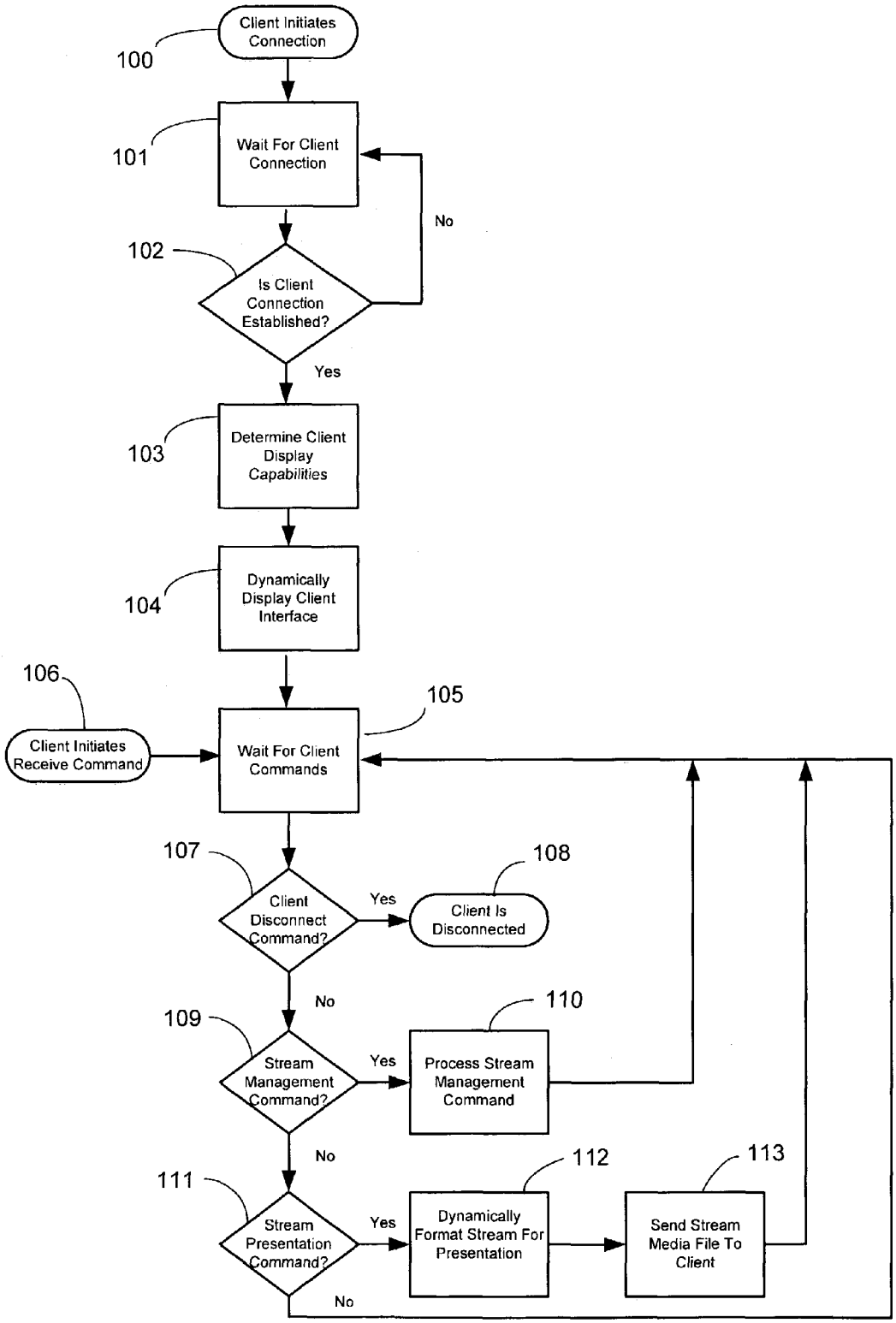
FIG. 6 is a flowchart of a streaming media file delivery and management process to the preferred embodiment.

FIG. 6 illustrates flow chart of a streaming media file delivery and management process. In step 100 a user initiates a connection to the streaming media server. The streaming media server is responsible for providing a user interface to the end user and for streaming the audio and media content. The specific type of user interface will be dynamically rendered depending on the device the user is using to access the streaming media server. For example, if the user is using a mobile phone, the interface may be displayed using WAP, or if the user is using a standard web browser, the interface may be presented in HTML. In step 101, the data retrieval system waits for the user connection. A determination is made if the user connection is established in step 102. If the user connection is not established, then a return is made to step 101 to await for the user connection. If the user connection is established in step 102, then the users capabilities are determined in step 103. Examples of user capabilities include system configuration, decoders, and multimedia players. After it is determined what device the user is using to access the streaming media server and what the user capabilities are, the specific type of user interface will be dynamically displayed in step 104.

In step 106, the user initiates a receive command. In step 105, the data retrieval system waits for the users command. A determination is made whether the user has entered a client disconnect command in step 107. If the user has entered the client disconnect command, then the user is disconnected in step 108. If the user has not entered a client disconnect command, then a determination is made whether a streaming management command has been entered in step 109. If a streaming management command has been entered, then a management option is performed in step 110. The management option may include saving the streaming media file to the local computer for later playback or a delete operation. A return is then made to step 105 to await the user's next command. If the streaming management command, is not entered in step 109, then a determination is made whether a streaming presentation command is entered in step 111. If the streaming management command is entered in step 111, then the data retrieval system streaming media server dynamically formats the streaming media file for presentation in step 112. The streaming media is then sent to the user for presentation in step 113. A return is then made to step 105 to await the user's next command. If a determination is made in step 111 that a streaming presentation command is not entered in step 111, then a return is then made to step 105 to await the user's next command.

As a result of the forgoing interactions of the server components, a user is able to listen to converted text items without requiring their own text-to-speech conversion tools. Items to be converted (e.g. email notes, stories from news services, and other internetwork text sources) are automatically retrieved on behalf of the user who can then access the audio files at the user's convenience.

What is claimed is:

1. A method of providing text-to-speech streaming data using a distributed network based message processing system, said system including a user access server for controlling access of registered users to said system, an internetwork data retrieval server for retrieving raw data from an internetwork, a text-to-speech server for converting said raw data to an audible speech data, and a memory storage output device for storing a streaming media file containing said audible speech data, a streaming media server for transmitting said audible speech data to said registered users via said internetwork, the method comprising the steps of:

authenticating a registered user;

retrieving said raw data from said internetwork;

parsing said raw data for text passages;

converting said text passages to said audible speech data;

converting said audible speech data to said streaming media file;

storing said streaming media file in a memory storage output device;

outputting a streaming media file to said registered user.

2. The method of claim 1 wherein said user access server includes a new user registration module for registering and allowing access for said new user to said system.

3. The method of claim 1 further comprising the step of registering a new user and allowing access for said new user to said system.

4. The method of claim 1 further comprising the step of de-registering a registered user from said system.

5. The method of claim 1 wherein said accessing said registered user includes customizing a user profile database containing user preferences.

6. The method of claim 5 wherein said raw data is retrieved from said internetwork in response to said user preferences.

7. The method of claim 1 wherein said registered user manually identifies a specific file or data block of said internetwork from which said raw data is retrieved from.

8. The method of claim 1 wherein said system includes a LAN for linking said servers on said system.

9. The method of claim 1 wherein said retrieving step includes a plurality of data retrieval modules, and wherein each data retrieval module retrieves a specific type of said raw data.

10. The method of claim 1 wherein said retrieving step includes transmitting a new data message to said text-to-speech server after said retrieving step.

11. The method of step 1 further comprising the step of compressing said media file using a media encoder.

12. The method of step 1 further comprising the steps of extracting meta-data from said parsed raw data and transmitting it with said streaming media file.

13. The method of step 12 wherein said meta-data is embedded in said streaming media file.

14. The method of claim 12 wherein said meta-data includes non-text attachments.

15. The method of claim 12 wherein said meta-data includes header information from email messages.

16. The method of claim 1 further comprising the step of transmitting a new streaming file message to said registered user that said streaming media file is available in said output device.

17. A distributed network based message processing system for providing text-to-speech streaming data to a registered user on said system, said system comprising:

a user access server for authenticating said registered user and for allowing access to said system;

an internetwork data retrieval server linked to said user access server for retrieving of raw data within said internetwork;

a text-to-speech server linked to said retrieval system server for parsing said raw data, converting said parsed raw data to audible speech data, and for converting said audible speech data to a streaming media file;

a memory storage output device linked to said text-to-speech server for storing a streaming media file; and a streaming media server linked to said memory storage output device for transmitting a streaming audio output of said streaming media file to said registered user.

18. The data retrieval system of claim 17 wherein said memory storage output device is located within said streaming media server.

19. The data retrieval system of claim 17 further comprising a LAN line for linking said servers.

20. The data retrieval system of claim 17 wherein said servers reside within a common hardware device.

21. The data retrieval system of claim 17 wherein said user access server includes a new user registration module for registering and allowing access for said new user to said system.

22. The data retrieval system of claim 17 wherein said user access server includes a user de-registration module for removing said registered user from said system.

23. The data retrieval system of claim 17 wherein said user access server includes a user profile database storing respective user preferences.

24. The data retrieval system of claim 23 wherein said user preferences includes access information to an at least one media service available through a service provider coupled to said internetwork.

25. The method of claim 17 wherein said user preferences included identifiers indicating said raw data for retrieving.

26. The data retrieval system of claim 17 wherein said registered user manually identifies a specific file or data block of said internetwork from which said raw data is retrieved from.

27. The data retrieval system of claim 17 wherein said text-to-speech server parses said raw data for portions containing text and converts said text to said audible speech data.

28. The data retrieval system of claim 27 wherein said text-to-speech server includes a media encoder for compressing said audible speech data.

29. The data retrieval system of claim 28 wherein said text-to-speech server converts said compressed audible speech data to a streaming media file.

30. The data retrieval system of claim 17 wherein said streaming media file includes a meta-data extracted from said raw data.

31. The data retrieval system of claim 30 wherein said meta-data includes non-text file attachments.

32. The data retrieval system of claim 31 wherein said new data comprises an email message and wherein said meta-data includes header information from said email message.

33. The data retrieval system of claim 32 wherein said memory storage output device provides said streaming media file to said registered user.

* * * * *